United States Patent [19]

Home

[11] 4,251,970

[45] Feb. 24, 1981

[54] THIN SHEET HAVING PUNCHED-OUT ADHESION PROJECTIONS FOR USE IN COMPOUND STRUCTURES, AND COMPOUND STRUCTURES CONSTRUCTED THEREWITH

[76] Inventor: Matti P. Home, Pietarinkatu 18, 00140 Helsinki 14, Finland

[21] Appl. No.: 910,299

[22] Filed: May 30, 1978

[51] Int. Cl.[3] ..... E04C 2/42

[52] U.S. Cl. ..... 52/674; 52/724; 52/725; 52/675

[58] Field of Search ..... 52/724, 725, 727, 674, 52/673, 675, 310, 577; 138/154

[56] References Cited

U.S. PATENT DOCUMENTS

| | | | |
|---|---|---|---|
| 759,378 | 5/1904 | Jones | 52/675 |
| 775,927 | 11/1904 | Kahn | 52/675 |
| 1,264,991 | 5/1918 | Stewart | 52/674 |
| 1,877,964 | 9/1932 | Parser | 52/674 |
| 1,932,671 | 10/1933 | Pfistershammer | 52/673 |
| 1,945,683 | 2/1934 | Fullman | 52/673 |
| 2,047,236 | 7/1936 | Thomas | 52/673 |
| 2,064,910 | 12/1936 | Harper | 52/675 |
| 2,316,349 | 4/1943 | McMinn | 138/154 |
| 3,328,869 | 7/1967 | Lannert | 52/673 |
| 3,435,852 | 4/1969 | Trihey | 138/154 |
| 3,511,246 | 5/1970 | Westerbarkey | 138/154 |

FOREIGN PATENT DOCUMENTS

| | | | |
|---|---|---|---|
| 46344 | 5/1966 | Fed. Rep. of Germany | 52/673 |
| 35007 | 6/1922 | Norway | 52/675 |
| 20452 | of 1889 | United Kingdom | 52/675 |
| 7952 | of 1909 | United Kingdom | 52/673 |

*Primary Examiner*—Price C. Faw, Jr.
*Assistant Examiner*—H. E. Raduazo
*Attorney, Agent, or Firm*—Steinberg & Raskin

[57] ABSTRACT

Thin sheet suitable for use as a mold and as a reinforcement in a compound structure with a poured component such as concrete or plastic has a set of punched-out adhesion projections or tongues for providing improved adhesion between said thin sheet and said poured component. Said sheet can serve as mold for said poured component and as reinforcement for said compound structure. Compound structures comprising such thin sheet with projecting tongues are disclosed.

16 Claims, 17 Drawing Figures

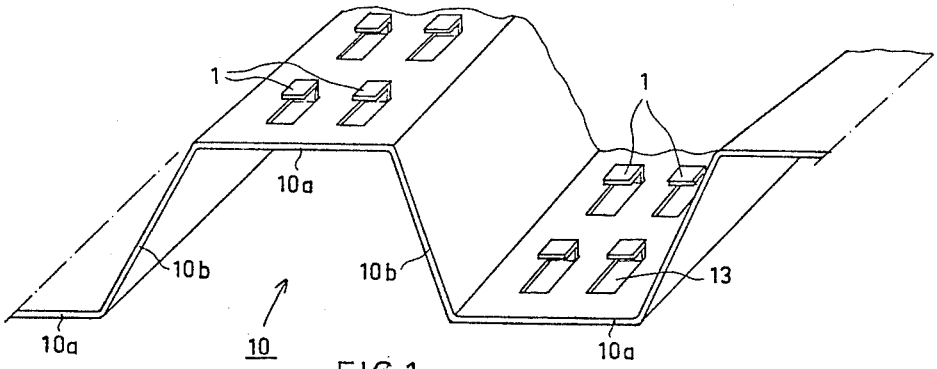
FIG.1
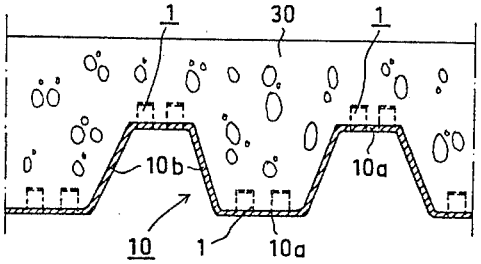
FIG. 2
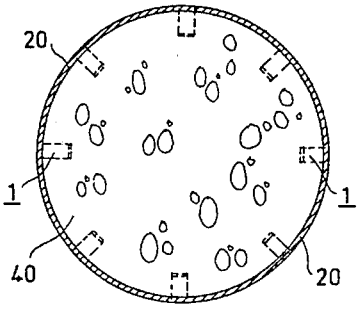
FIG.3
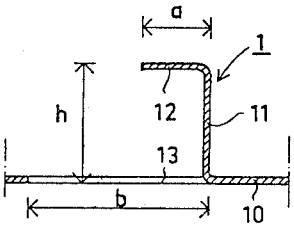
FIG.4
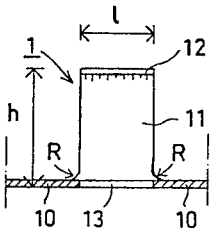
FIG.5
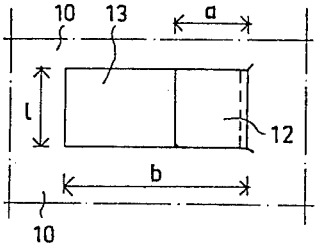
FIG.6
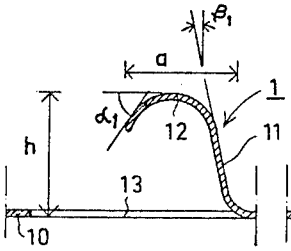
FIG.7
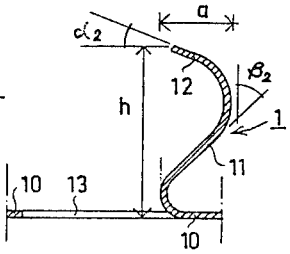
FIG.8
FIG.9
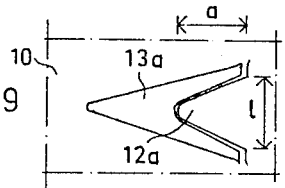
FIG.10
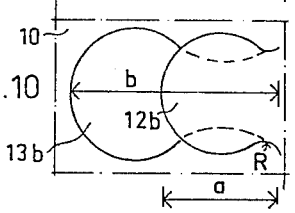

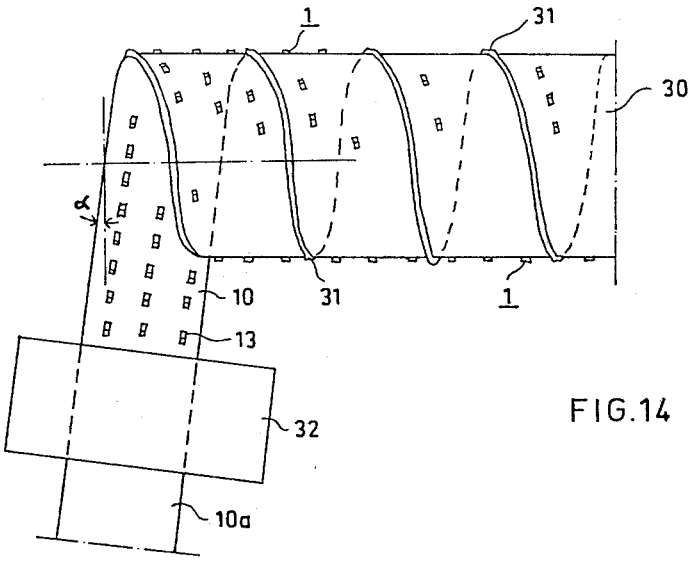
FIG.14
FIG. 15
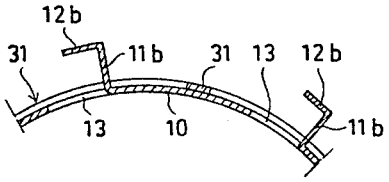
FIG.16
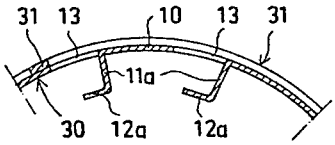
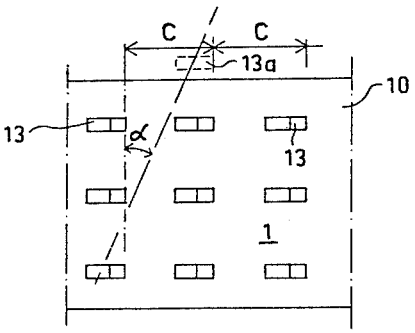
FIG. 17

THIN SHEET HAVING PUNCHED-OUT ADHESION PROJECTIONS FOR USE IN COMPOUND STRUCTURES, AND COMPOUND STRUCTURES CONSTRUCTED THEREWITH

BACKGROUND OF THE INVENTION

The present invention concerns compound structures and, more specifically, a set of adhesion projections between a poured component and a thin sheet of the compound structure. It is well-known, of course, that in compound structures their strength and other characteristics are decisively determined according to the adhesion which exists between the thin sheet component and poured component of the compound structure.

In the foregoing we have spoken of a thin sheet component, and this is understood to mean a steel sheet, plastic sheet or another equivalent thin sheet from the material of which the set of adhesion projections is produced by punching. The poured component of the compound structure is meant to be concrete, plaster, light weight concrete such as "Siporex", foam-expanded plastic, "Styrox", or another equivalent substance which may be brought into such condition that it will surround the set of adhesion projections constituting the object of the invention, in view of producing the intended compound structure.

The description of the invention now following is mainly concentrated on the embodiment of the invention wherein the poured component of the compound structure is concrete and the thin sheet is a steel sheet, which preferably furthermore serves as mold board in the pouring process and which need not be removed. It should be emphasized in spite of this that the invention is in no way confined to compound structures of concrete and steel; in contrast, all above-mentioned components of a compound structure may be mutually combined and in many such compound structures those advantages and aims are achieved which the invention is meant to gain. It is also possible to use two or more different poured components on opposite sides of the thin sheet, in which case the set of adhesion projections or tongues of the invention must be provided on both sides of the thin sheet.

The set of adhesion projections of the present invention is particularly appropriate for a compound structure used in concrete construction and which comprises, for instance, a thin sheet serving as a mold and a set of adhesion projections produced from the sheet material itself, a kind of "nails" by the aid of which one achieves, for instance, between the thin sheet used in making the mold and the cured concrete, an adhesion of such efficiency that the mold becomes a functional part of the structure and which in the case of a thin sheet of steel constitutes a steel reinforcement.

In the prior art it is commonly known to use thin steel sheet as the mold in the making of reinforced concrete slabs, columns and beams and in the making of relief cavities, but the task of the mold has generally been considered terminated after concreting is completed. In most instances the mold is dismantled after the concrete has hardened.

Furthermore, in the prior art corrugated sheets made of thin steel sheet are known, which are used in concrete construction both as mold and for reinforcement, the adhesion between the concrete and the thin sheet being accomplished by appropriate shaping of the sheet and/or by making on the surface of the sheet, knobs, grooves or folds. The drawback of these designs is the low adhesion between the concrete and the corrugated sheet, also the fact that this kind of mold is effective only as active reinforcement in a so-called unidirectionally bearing slab, so that this type of mold is unfit for use as reinforcement of, for instance, beams, columns and walls.

Perhaps the closest prior art is that disclosed in the German DOS No. 2 325,281, which teaches various sets of adhesion projections between concrete and thin sheet, said projections consisting of loop-like strips pressed outwardly from the plane of the thin sheet. FIGS. 7 and 8 of said reference display also adhesion projections which start substantially at right angles to the plane of the sheet on both sides of the punched aperture, or the respective projections are annular punch-outs. However, loop-like projections have the drawback that the concrete does not completely penetrate and surround the loop, whereby the adhesion between concrete and sheet remains poor. Furthermore, German DOS No. 2 325 281 contains no description of the significance which the shape and dimensional proportions of the adhesion projections and the size of the punch-out carry in view of the adhesion phenomenon.

SUMMARY OF THE INVENTION

It may be observed in general that with the aid of a set of adhesion projections produced from thin sheet by punching, rolling or in other ways, the adhesion between the mold and the concrete can be made efficient enough so that after curing of the concrete the mold or equivalent will efficiently reinforce the concrete in all directions. It is one of the consequences of this characteristic that the design taught by the invention is applicable in the reinforcement of concrete beams and columns and of crosswise bearing concrete slabs, and of concrete walls. When the design of the invention is employed in order to form relief cavities in concrete structures, the mold will, after the concrete has hardened, reinforce the vicinity of the hole and it will operate, when the structure is put under load, as a reinforcement of the traction and compression sides.

It is a general object of the invention to produce a set of adhesion projections or tongues which makes the thin sheet into a usable reinforcing member in all commonly made concrete structures, such as beams, columns, slabs, walls, shells, etc.

It is a special object of the invention to produce a set of adhesion projections such that moving about on the sheets will be safer than before, so that there is no fear of the "adhesion nails" penetrating the shoe sole or of a "nail" passing through a worker's clothes if he falls on such a plate.

It is also an object of the invention to provide a set of adhesion projections by the use of which the transporting costs of the sheets can be lowered for the reason that the sheets stacked upon each other fit more closely together than in prior art.

It is an additional object of the invention to produce a set of adhesion projections such that the adhesion projections and the punch-outs therewith associated will be small in size, in which case the adhesion between the thin sheet and the concrete is accomplished without any great loss of steel cross section. This also affords the special advantage that the punch holes in the thin sheet need not be completely covered over since the concrete cannot in detrimental degree penetrate through the holes, which can be made comparatively small.

It is further an object of the invention to produce a set of adhesion projections such that it can be produced on all possible kinds of sheet and on different sheet profiles even by the same apparatus if need be, whereby one avoids the necessity of a special machine, and the manufacturing procedures are simple and the manufacturing costs can be even further reduced.

It was one of the realizations from which this invention started, that for instance compared with the nail boards known in prior art, the "adhesion nails" between the concrete and the thin sheet have no need for penetration and therefore no special restrictions need be imposed on the shape of the "nail's" point.

In order to achieve the aims presented above, and others which will become apparent later, the invention is mainly characterized in that the strips which are formed on punching the set of adhesion projections attach to the thin sheet preferably by one margin only and the strips have been bent to project from the plane of the thin sheet so that the strips have an extension at right angles to the principal plane of the sheet in a magnitude preferably substantially equal to the extension in the direction of the principal plane. It is moreover of advantage if the dimension of the projections parallel to the principal plane is directed over the punch-outs and partially covers the punch-out in the direction at right angles to the principal plane. It is achieved by the last-mentioned design that the pouring component of the compound structure, such as concrete for instance, cannot flow out through the hole of the punch-out in any harmful degree. The strips are furthermore favorably hook-shaped and they may be formed, and particularly elongated, in their longitudinal direction if need be.

The substantial advantages of the hook-like adhesion projections of the invention, compared for instance with straight nails of the same total length, include a higher working safety than before when the sheets are being handled, lower transport costs because the sheets can be more closely stacked, and smaller punch-out holes than before when optimum adhesion is being employed.

When using the set of adhesion projections of the invention, one may in the calculations enter the whole remaining cross section of the thin sheet as active cross section, and this is an important advantage in view of dimensioning.

It should be noted in this connection that although in the foregoing steel reinforcement has been described, it should be understood that the protective scope of the invention also includes structures wherein as thin sheet a sheet other than steel is used, for instance, an equivalent metal sheet or a plastic sheet or other combination, or equivalent.

Another object of the invention is to provide a new use for a set of adhesion projections of the kind just discussed. In the following the state of art associated with this use will be reviewed.

When the set of adhesion projections of the invention is used for producing relief cavities in concrete structures, the object of the novel use of the invention is to provide a structure wherein immediately after curing of the concrete the mold will reinforce the concrete in the vicinity of the hole and it will at loading of the structure serve as reinforcement on the traction and compression sides.

In the prior art the use of thin sheet steel and cardboard tubes as weight relief tubes for hollow slabs concreted on the site is known. In addition, thin sheet steel and cardboard tubes are known which are intended for the concreting of columns. In such cases no compound structure has been involved since the mold is removed, or for instance a steel mold used for the pouring of concrete columns and which has been left in its place cannot be said to have cooperated with the concrete since the adhesion therebetween is poor.

It is known in the prior art to produce hollow slabs concreted on the site, in the following way in its main outline. The mold is first erected for the vault and the tension-reinforcing steels are installed on a plastic or concrete podest. The relief tubes are then installed, after preferably first assembling them into a so-called tube battery. The reinforcement comprises as a substantial part, two crossing reinforcing steel nets bent to trapezoidal shape and within which there remain mutually adjacent spaces for the relief tube molds. Furthermore, the reinforcement comprises in its lower part a tension reinforcement and upper staying steels or ancillary steels, and anchoring steels, by the aid of which the tube battery is anchored in its place, using mold locks. However, the making of the reinforcement is work which requires professional skill and much time.

In hollow slabs tension tends to occur around the cavity, whereby the battery reinforcement of the reinforcing arrangement just described will also operate as tension steel. It is in fact a special object of the present invention, to provide a hollow slab wherein its cavity mold serves advantageously as a concrete reinforcement and as a compound structure together with the concrete. The invention has the equivalent object also in the producing of concrete columns. It is furthermore an object, to achieve faster and simplified reinforcement laying, so that for instance in hollow slabs said battery steels and in columns the tension and clamp steels may be omitted.

In order to attain the aims presented and others which will become apparent later, the new application of the invention is mainly characterized in that the set of adhesion projections is employed in a compound structure wherein the thin sheet component is a helically-seamed tube provided with a set of projections constituted by the strip material of the helically-seamed tube and which contributes to producing the requisite adhesion between the thin sheet and poured components in the compound structure.

When using, according to the invention, an adhesion projection set in a compound structure wherein the thin sheet component is a helically-seamed tube which has been provided with sets of adhesion projections consisting of punch-outs of the strip material, one obtains a thin sheet component which is fast and simple to produce and which is as favorable as possible in its characteristics specifically as a thin sheet component. This favorable character is based on the fact that the punch-outs, which are comparatively easily produced in the narrow strip material for the helically-seamed tubing in connection with the manufacturing of such tubing, give rise to such a set of projections which guarantees efficient adhesion with the poured component of the compound structure. Hereby in hollow slabs and columns, for instance, the helically-seamed tube operates both as concreting mold and as concrete reinforcement so that an advantageous compound structure is formed. When the said set of projections is dense enough, then in hollow slabs the tension appearing on the margins of their cavity will be taken up by the helically-seamed tube and thereby the concrete in the vicinity of the hole is reinforced in such manner that the generation and spread of cracks around the hole will be avoided. It is a particular advantage in column structures that in addition to the advantageous compound structure, the helical seam of the helically-seamed tube, which is either a folded seam, but preferably a strong welded seam, also affords a helical reinforcing structure which obviates the use of mold hooks even if the wall thickness of the thin sheet should be comparatively small.

The following further advantages may be mentioned, among the new and unexpected advantages gained by the new use of the invention. The punch-outs of the helically-seamed tube operate in unexpected manner because in case of fire, the water in the concrete, as it evaporates, may escape through the holes and no explosion can occur.

In hollow slabs an unexpected additional advantage is the holes in that the water occurring during the construction period and which has caused surprises in many connections can escape from the tube without obstruction and can be absorbed in the concrete after the concreting has been done. In column structures, the invention has the advantage that the mold is easier to fill than are molds fitted with a conventional reinforcement.

At present several different methods and various apparatus are known for producing helically-seamed tubing from metal strip material, which has been given an expedient profile prior to the seaming operation, this profile enabling the final seam to be accomplished either by folding or by welding. Furthermore, methods and apparatus are known by which it is possible to manufacture tubing with continuously changing diameter, for instance tube sections of conical shape. It is not intended here to give any more detailed account of the apparatus for producing helical tubing either with a closed folded or a welded seam or of the respective methods.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 shows a corrugated sheet, provided with a set of adhesion projections as taught by the invention;

FIG. 2 shows, as a slab structure, the combination of a corrugated sheet provided with a set of adhesion projections of the invention, and of concrete;

FIG. 3 shows a set of adhesion projections of the invention, employed in a column structure with circular cross section;

FIG. 4 shows in detail an embodiment of the invention;

FIG. 5 shows the embodiment of FIG. 4 viewed from the opposite direction;

FIG. 6 shows the same embodiment as FIGS. 4 and 5, viewed in a direction perpendicular to the plane of the thin sheet;

FIG. 7 shows in like manner as FIG. 4, another alternative shape of the adhesion projection;

FIG. 8 shows in like manner as FIGS. 4 and 7, still a third alternative for the shape of the adhesion projection;

FIGS. 9 and 10 present two alternative ways of carrying out the adhesion projection and the punch-out giving rise to it;

FIG. 14 shows schematically a helically-seamed tube thin-sheet component for use in a compound structure of the invention, in the process of manufacturing;

FIG. 15 shows a partial cross section of a helically-seamed tube for use in the invention;

FIG. 16 shows in like manner as FIG. 14 another embodiment of the helically-seamed tube; and FIG. 17 shows part of the steel strip after punching, the helically-seamed tube of the invention being made of this strip.

DESCRIPTION OF THE PREFERRED EMBODIMENTS

Figure 11:
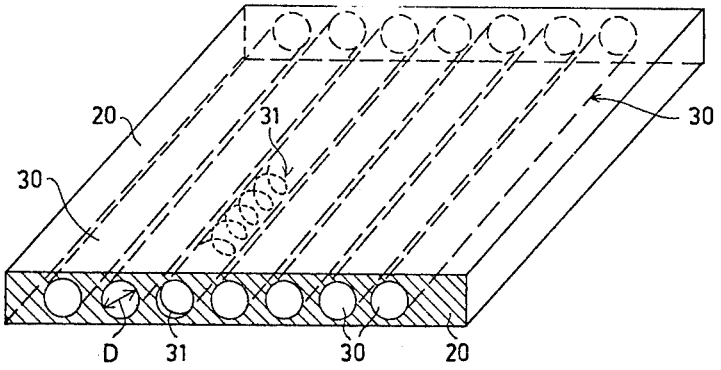
FIG. 11 shows, in axonometric view, schematically, a hollow slab as taught by the invention.
Figure 10A:
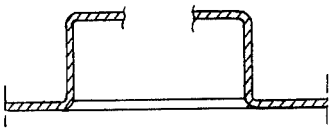

Referring now to FIGS. 1 and 2, the corrugated sheet 10 shown therein presents flanges 10*a* parallelling the principal plane and flanges 10*b* connecting these. The flanges 10*a* carry a set of adhesion projections 1 according to the invention, this set having been produced by bending strips, produced upon punching the flanges, in their entirety into a precisely defined shape. The density and spacing of the punch-outs 13 and of the strips depends on the degree of adhesion which is required in each instance. Although in FIGS. 1 and 2 a set of adhesion projections or tongues has only been shown on the flanges 10*a*, it is to be understood that it may also be applied on the flanges 10*b* if needed.

As shown in FIG. 3, a set of tongues 1 has been provided in connection with a tubular column mold of thin sheet 20, this mold producing the reinforcement for a concrete column 40. The column mold 20 consisting of the thin sheet 20 has been made of tube with a side seam, and it has been punched with a desired spacing to produce the set of tongues 1. It should be noted in this connection that the invention is in no way restricted merely to the applications shown in FIGS. 1, 2 and 3, that is to slabs 30 and columns 40: the invention may be equally applied in the case of beams, walls, shells, etc.

FIGS. 4 to 10 display a number of advantageous embodiments of the tongues of the invention. As shown in FIGS. 4, 5 and 6, from the punch-outs 13 made in the thin sheet 10, which have substantially rectangular shape, hook-like adhesion projections have been bent out, which consist of a section 11 substantially at right angles to the plane 10 of the sheet and of a section 12 connected therewith, said section 12 being substantially parallel to the principal plane of the sheet 10 and preferably partially overlying punch-out 13. However, angulation in the opposite direction is advantageous in certain cases.

As shown in FIGS. 7 and 8, the set of adhesion projections is not necessarily angulated or bent at sharp angles; it has in cross section a curved shape, and as shown in FIG. 7 the section 11 of the strip adjoining the sheet 10 is inclined at the angle $\beta_1$ towards the punch-out 13 with reference to the plane perpendicular to the sheet 10, and the tip of the section 12 forms the angle $\alpha_1$ with the plane parallelling the sheet 10. As shown in FIG. 8, the principal direction of the strip 11 is inclined at an angle $\beta_2$ away from the punch-out and the tip of the section 12 at an angle $\alpha_2$ away from the plane of the sheet 10. As is evident from FIGS. 9 and 10, the punch-outs need not be rectangular; as shown in FIG. 9, the punch-out 13*a* is substantially triangular, and as shown in FIG. 10 the punch-out has a curved shaped so that the section 12*b* is substantially circular and therefrom departs a somewhat thinner attachment stalk, expanding towards its root, to the sheet 10.

The tongues 1 shown in FIGS. 4 to 10 display in common the essential feature of the invention, that each tongue has, starting from the sheet, the perpendicular extension h and the extension a in the direction of the sheet's plane, the latter constituting for the tongue a hook-like supporting projection 12, 12*a* and 12*b*. It is further of advantage if the tongues 1 adjoin the punch-out 13 of the sheet 10, 12 by one edge only. In some instances, particularly when the strips have been elongated, the adhesion projections may arise from two opposing edges of the punch-out in the sheet 10, 20, as seen in FIG. 10*a*, or even from two adjacent edges.

To obtain optimum adhesion, the extension a of the strips is preferably up to about 50% less than the extension h. It is an essential features of the invention that the extensions a and h of the strips are equal in order of magnitude. It is also advantageous if the breadth l of the strips is equal in order of magnitude to the extensions a and h.

Since the strip formed out of the punch-out 13 of the sheet 10 is used in its entirety as one piece to serve as supporting projection, it follows that for instance in FIGS. 4, 5 and 6 the length of the punch-out 13 is $b=h+a$. It is also possible subsequently, particularly in their tip portion, whereby the dimension b will be less than the equivalent total length of the strip. This is particularly advantageous when it is desirable to make the area of the punch-outs as small as possible.

In tests it has been found to be important that the root of the sections 11 adjoining the sheet 10 be rounded with an appropriate radius R, whereby in load application cases the whole active cross section area of the set of tongues 1 can be utilized.

The absolute magnitude of the above-mentioned dimensions a, b, h and l depends, for instance, on the application of the particular set of adhesion projections and above all on the material and thickness of the thin sheet 10 which is used. It may be mentioned as an example that when the thin sheet 10 consists of sheet steel with thickness 0.5 to 0.1 mm, the appropriate average width l of the strips is preferably about 2 to 7 mm, their height h about 5 to 10 mm and the extension parallel to the plane of the sheet, a, about 2 to 8 mm.

When the thin sheet 10 consists of deformable sheet metal, it is possible to elongate the strips punched out therefrom, in particular in their longitudinal direction and in the part adjacent to the free end of the strip. Such elongation is particularly favorable when it is desired to minimize the area of the apertures 13 constituted by the punch-outs. When applying said elongation process, one may also produce and bend the strips constituting the set of tongues from two opposed margins of the aperture 13. In some cases said strips may be bent out from two opposed edges of the punched aperture even when no elongation is applied. It is further possible to roughen the strips, to provide them with grooves, undulation or other equivalent arrangements which promote the adhesion between the strips and the poured component of the compound structure.

The punched apertures arising when the set of adhesion projections is produced and which remain uncovered, as long as they can be made small enough, present also the advantage that through them the spreading of the poured component of the compound structure to become contiguous with the thin sheet 10 can be inspected and thereby potential empty spaces can be detected. In prior art the drawback has been encountered for instance in compound structures consisting of a corrugated sheet and concrete, that no such inspection could be made because either there have not been any such punched holes at all or, having a rather large area, they have to be covered with a special additional foil.

It has been found in comparative examinations involving a set of adhesion projections as taught by the invention, that the adhesion strength between the thin sheet and the concrete surface improves by about 20 to 25% when the hook-like tongue of the invention is used (projection of FIGS. 4 to 6), compared with straight band-like projections of equal length.

In the above-described embodiment examples of the invention, the set of adhesion projections has been presented as extending on one side of the thin sheet 10 only. It should be understood, however, that the thin sheet 10 or equivalent may equally carry sets of tongues 1 extending on both sides of its plane, for instance in an application of the invention wherein there will be a poured component of the compound structure on both sides of the thin sheet, in which case the two-sided set tongues of the thin sheet will cause adhesion to both poured components, which may furthermore be different, for instance one consisting of concrete and the other of light weight concrete, plastic, or equivalent.

It may also be noted that the invention can be said to afford the new and unexpected effect that when using "nails" hooked at the end there are obtained, in addition to better adherence, other advantages in completely different respects such as those already mentioned which are associated with safety of work and transportability, and those connected with the use of the sheets.

FIG. 11 displays, as an example of a new application of the invention, a hollow slab 20, which has been relieved and reinforced by means of helically-seamed tubes 30 made of steel band 10. The hollow slab 20 presents spaced-apart relieving cavities each encircled by a helically-seamed tube 30, there being a plurality of such cavities in parallel and equally spaced, and their diameter being denoted with D.

Figure 12:
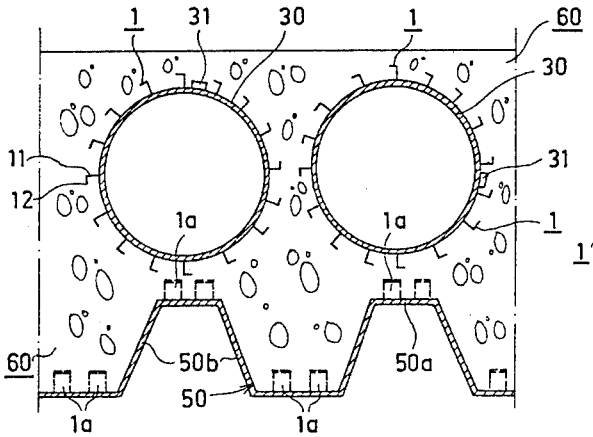
FIG. 12 shows a cross section of a hollow slab having a corrugated sheet as one of its surfaces.

The hollow slab 60 depicted in FIG. 12 is otherwise like that of FIG. 11, except that it further comprises a corrugated sheet 50 serving a mold board and as tension reinforcement, this sheet 50 consisting of portions 50*a* parallelling the principal plane of the sheet 50 and of oblique portions 50*b* therebetween. In this slab 60 the corrugated sheet 50 as well as the helically-seamed tubes 30 constitute a compound structure together with the concrete, the thin sheet components 30 and 50 being provided with a set of tongues 1, 1*a*.

Figure 13:
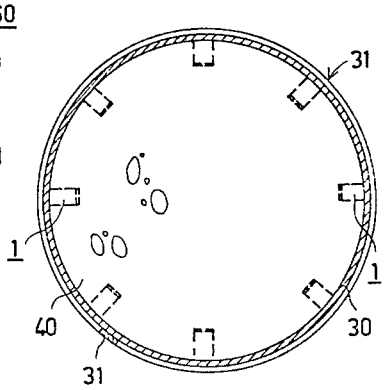
FIG. 13 shows, in cross section, a column structure as taught by the invention.

The compound structure shown in FIG. 13 consists of helically-seamed tube 30, which serves as a column mold, this mold providing the reinforcement of the concrete column 40. The helically-seamed tube 30 has been punched with desired spacing to produce a set of tongues 1. It should be noted in this connection that the new application of the set of adhesion projections as taught by the invention is by no means confined to the compound structures of FIGS. 11, 12 and 13, that is to hollow slabs 20, 60 and to columns 40; the invention may equally be applied to beams, walls, shells, tubes, etc.

As shown in FIG. 14, the helical tube applied in the invention is made of band steel 10 by winding, using conventional helically-seamed tube-making machines. These known machines are not shown, and in FIG. 14 only an apparatus schematically represented by the block 32 can be seen, which produces the punching of the steel band 10 required in order to produce a set of adhesion projections. This punching means 32 is placed, for instance, before the equipment accomplishing the seaming of the helically-seamed tube 30. The unpunched part of the steel band 10 carries the reference numeral 10*a*. The helically-seamed tube 30 is provided with a closed folded seam and/or a welded seam, 31. The type and strength of this seam is selected in accordance with the degree to which it is desired to strengthen the helically-seamed tube 30 by the aid of this seam 31. The welding and seaming means do not belong to this invention, and their details can be read from earlier art. As regards the seam 31 of the helically-seamed tube, this seam may be located on the inside or outside of the tube 30; in columns for instance it is advantageous if the seams 31 remain on the inside, whereby the outer surface will be smooth.

As shown in FIG. 16, the flanges 11*a* and 12*a* of the adhesion projections 1 extend towards the inside of the tube 30, and a tube of this type is used, for instance, in the columns of FIG. 13. The set of adhesion projections shown in FIG. 8 is preferable to that of FIG. 3, since the flanges of the set of adhesion projections 1 are parallel to the longitudinal direction of the column as a result of which the adhesion projections 1 will not hamper the penetration of the concrete mix within the helically-seamed tube mold, as would a set of tongues arranged as shown in FIG. 3.

As shown in FIG. 15, the set of adhesion projections consisting of the flanges 11*b* and 12*b* is outwardly directed from the helically-seamed tube 13. However, it may be advantageous when making hollow slabs 20 to arrange the set of adhesion projections 1 to have its plane transverse to the longitudinal direction of the helically-seamed tube 30.

As shown in FIG. 17, the steel band 10 has been provided with three rows, side by side, of punch-outs 13, of which the set of tongues 1 is composed. The spacing of the rows of punchings 13 has been indicated with the character c. This dimension c is preferably chosen so that, considering the pitch angle of the seam 31 of the helically-seamed tube, the punch-outs in adjacent rows will be uniformly distributed with reference to the longitudinal axis of the helically-seamed tube. This arrangement is illustrated in FIG. 9 by the imagined next punching 13*a*. A punching like that of FIG. 9 is advantageous in weight-relieving tubes. In column molds, on the other hand, it is to be preferred that the punchings 13 are aligned with the longitudinal axis of the tube 30, whereby the reinforcement can be more easily defined. The spacing of the punch-outs, the dimensions of the set of tongues and their shapes are selected according to the adhesion required in each case.

As further regards the sets of adhesion projections described, it is also possible within the scope of the invention to bend the set 1 out from two opposed or adjacent margins of the punch-outs 13, particularly when the strips constituting the tongues 1 are elongated. One may also use sets where the punched strips adjoin to the thin sheet 10 at both ends, although mostly these are not favorable in view of the spreading of the poured component. In some instances also other types of tongues may be applied, such as cylindrical ones, which adjoin to the whole circumference of the punched hole. However, sets such as have been presented are more advantageous.

Such applications are also within the scope of the invention in which the poured component is not concrete but, for instance, light weight concrete, "Siporex", plaster, foam-expanded plastic or equivalent. One may further use one or several poured components so that the set of adhesion projections extends on the helically-seamed tube both inwardly and outwardly. The compound structure may then consist, for instance, of two coaxial, different diameter helically-seamed tubes, the inner tube being provided with an outwardly pointing set of adhesion projections and the outer helically-seamed tube, with a set of adhesion projections pointing both inward and outward, and the annular space between these tubes being filled with the first poured component and the outer tube being surrounded by another poured component. By using the helically-seamed tube of the invention and its set of adhesion projections, one gains in addition to good adhesion the further advantage that the thermal conductivity between the helically-seamed tube and the poured component increases, which may be a remarkable advantage in some applications.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A thin sheet for serving as reinforcement and mold for a poured material, said sheet having a plurality of apertures and at least one tongue projecting from a portion of the margin of each said aperture, each said tongue being a punched-out portion of said sheet defining corresponding ones of said apertures, and having a root integral and continuous with said sheet, a first portion of said tongue projecting away from said sheet and a second portion of said tongue lying essentially parallel to said sheet, and wherein each of said tongues at least partially overlies the corresponding aperture and has a free tip, said tips pointing in substantially the same direction, and wherein each of said tongues has a length dimension defined between said root and tip which is greater than the corresponding dimension of the corresponding aperture, and wherein said root has side edges which expand in a curve as they join said sheet.

2. A thin sheet for serving as reinforcement and mold for a poured material as defined in claim 1, wherein said first and second portions are substantially equal in length.

3. A thin sheet for serving as reinforcement and mold for a poured material, as defined in claim 2, wherein the breadth of each of said tongues is substantially equal to the length of said first portion thereof.

4. A thin sheet for serving as reinforcement and mold for a poured material, as defined in claim 1 wherein said tongues are curved and wherein said first portion of tongue projects away from said sheet at an angle.

5. A thin sheet for serving as reinforcement and mold for a poured material, as defined in claim 4, wherein said first portion of said tongue projects away from said sheet at an angle less than 90°.

6. A thin sheet for serving as reinforcement and mold for a poured material, as defined in claim 4, wherein the tip of said tongue points toward said sheet so that said tongue forms an angle with a plane extending parallel to said sheet.

7. A thin sheet for serving as reinforcement and mold for a poured material, as defined in claim 6, wherein said angle is less than 45°.

8. A thin sheet for serving as reinforcement and mold for a poured material, as defined in claim 6, wherein said angle is about 30°.

9. A thin sheet for servng as reinforcement and mold for a poured material, as defined in claim 1, wherein said second portion is up to 50% shorter than said first portion.

10. A thin sheet for serving as reinforcement and mold for a poured material, as defined in claim 1, wherein said apertures and said tongues are essentially rectangular.

11. A thin sheet for serving as reinforcement and mold for a poured material, as defined in claim 1, wherein said sheet is from about 0.5 mm to 1.0 mm in thickness, the average breadth of said tongues is from about 2 mm to 7 mm, the length of said first portion is from about 5 mm to 10 mm and of said second portion is from about 2 mm to 8 mm.

12. A thin sheet for serving as reinforcement and mold for a poured material, as defined in claim 11, wherein a pair of tongues project from opposed portions of the margin of each of said apertures.

13. A thin sheet for serving as reinforcement and mold for a poured material, as defined in claim 1, wherein said thin sheet is of a material selected from the group consisting of steel and plastic.

14. A thin sheet for serving as reinforcement and mold for a poured material, as defined in claim 1, wherein said poured component is a material selected from the group consisting of concrete, plastic, lightweight concrete, foam-expanded plastic and plastic.

15. A thin sheet for serving as reinforcement and mold for a poured material, as defined in claim 1, wherein said thin sheet has tongues projecting from both faces thereof and a poured component making contact with each of said faces.

16. A thin sheet for serving as reinforcement and mold for a poured material, as defined in claim 1, wherein different poured components make contact with each of said faces.

* * * * *